US005296101A

United States Patent [19]

Peterson

[11] Patent Number: 5,296,101

[45] Date of Patent: Mar. 22, 1994

[54] PAPER MACHINE DECKLE STRUCTURE WITH A C-CLIP SUPPORT BEAM

[75] Inventor: Ralph S. Peterson, Clifton Forge, Va.

[73] Assignee: Westvaco Corporation, New York, N.Y.

[21] Appl. No.: 957,873

[22] Filed: Oct. 8, 1992

[51] Int. Cl.[5] ..... D21F 1/56

[52] U.S. Cl. ..... 162/353; 162/272

[58] Field of Search ..... 162/208, 272, 281, 331, 162/353; 15/256.5, 256.51; 403/257, 261, 292, 294

[56] References Cited

U.S. PATENT DOCUMENTS

| | | | |
|---|---|---|---|
| 3,163,575 | 12/1964 | Nobbe | 162/281 |
| 3,607,624 | 9/1971 | Moody et al. | 162/272 |
| 3,869,344 | 4/1975 | Hunt | 162/281 |
| 4,124,441 | 11/1978 | Nykopp | 162/353 |
| 4,738,751 | 4/1988 | Newcombe | 162/353 |
| 4,953,689 | 9/1990 | Peterson et al. | 15/256.51 |
| 4,968,387 | 11/1990 | Beran et al. | 162/353 |
| 5,197,587 | 3/1993 | Malmberg | 15/256.51 |

*Primary Examiner*—Karen M. Hastings

*Attorney, Agent, or Firm*—J. R. McDaniel; W. A. Marcontell; R. L. Schmalz

[57] ABSTRACT

Paper machine deckle defining structure is protected from fiber accumulations by a uniformly distributed water film that continuously flows from a flat, horizontal upper surface over all smoothly faired lower surfaces of the deckle elements.

7 Claims, 2 Drawing Sheets

PAPER MACHINE DECKLE STRUCTURE WITH A C-CLIP SUPPORT BEAM

BACKGROUND OF THE INVENTION

1. Field of the Invention

The present invention relates generally to fourdrinier paper machines. More specifically, the present invention relates to deckle structures for confining the papermaking stock pond carried on the fourdrinier screen.

2. Description of the Prior Art

Fourdrinier paper machines are characterized by a closed loop web formation screen driven over an open, flat table surface. Extremely dilute, aqueous papermaking stock is jetted upon the traveling screen from a horizontally elongated nozzle; usually associated with a stock accumulation chamber called a headbox.

As the traveling screen carries the stock flow from the slice jet landing zone, aqueous vehicle, i.e., water, drains through the screen to leave the fiber constituent of the papermaking stock accumulated upon the upper screen surface as a consolidated mat.

Between the stock landing zone and that longitudinally displaced point along the screen belt traveling route whereat the mat consolidates into a paper web, the stock is supported on the screen surface as a liquid pond of diminishing depth. Without lateral containment, lateral liquid stock flow cross-directionally sweeps fiber towards the screen sides thereby undesirably tapering the paper web edge thickness.

To prevent such undesirable thickness tapering along the paper web edges, lateral pond confinement structures called "deckle boards" are positioned above and along the screen edges in the machine running direction from the slice landing zone. Traditionally, deckle boards are similar to a pair longitudinal dams, each extending along the screen traveling direction respective to each lateral edge of the screen with the screen per se running under the deckle boards.

A more recent innovation to the deckle structure has been to combine the deckle board with a screen edge cupping rail located outboard of the deckle board, as represented by U.S. Pat. No. 4,968,387 to R. L. Beran et al. The curled screen edges, traveling along respective, oppositely cupped rail profiles, hydraulically confine the stock pond. The deckle boards, internally of the cupped rails, are vertically positioned above the screen as to leave a substantial hydraulic channel beneath the lower deckle board edge. Machine white water fills the flow channel between the cupping rail and the outside surface of the deckle board. The inside faces of the deckle boards delineate the outer edge limits of the stock fiber. Standing waves generated in the stock pond are permitted to pass under the deckle board into white water channel and dissipate up the edge cup profile without reflection.

All deckle structure, whether of the traditional design or that using cupped rails, is positioned within close proximity of the energetically traveling stock pond. The structure is located within a virtual mist of fiber particles being continuously splashed from the traveling stock pond. These fiber particles have a high adhesive affinity for any solid surface such as is offered by the deckle structure. Fiber coatings continue to accumulate and soon begin to flake off in agglomerated chunks and fall into the fresh stock pond for web processing. Such web integrated chunks of agglomerated old fiber disrupt the web quality and runnability.

Although the prior art, as represented by U.S. Pat. No. 3,607,624 to W. R. Moody, has partially recognized the value of protecting the deckle structure with a continuously flowing water film, that recognition did not teach a functional structure that would adequately accomplish the objective. Many portions of the Moody structure are not water film flushed and are fiber accumulation surfaces.

SUMMARY OF THE INVENTION

It is, therefore, an object of the present invention to provide a configuration of deckle structure wherein virtually all external surfaces are continuously water-flushed.

Another object of the invention is provision of a deckle structure having smooth and continuously faired surfaces that will readily support a uniform fluid film.

Another object of the invention is to provide a deckle structure having a flushing film distribution fountain for uniformly distributing surface flushing water over the exposed deckle surfaces.

These and other objects of the invention are accomplished by deckle structures that are crowned by smooth, table flat fluid distribution surfaces. Fluid flow apertures through the distribution surface communicate the distribution surface with a fluid supply conduit. Such fluid flow apertures are located in regularly spaced alignment between the surface weir edge and a flow barrier whereby flow from a fluid pond on the distribution surface is in one direction from the barrier and over the weir edge. Cylindrical axes of the apertures are alternately oriented between vertical alignment to about 15° to 45° from vertical turned toward the weir edge.

Deckle structure below the weir edge is substantially smooth and continuously faired with no abrupt or horizontal surfaces.

In a preferred embodiment, the deckle board is fabricated as the bonded assembly of a polymethylmethacrylate (Plexiglas) structure body with a thin, polycarbonate (Lexan) deckle blade. Rail channels are formed in the Plexiglas body sides to slidably receive square section, C-clip bracket rails. The flat, C-clip bight section is matched to the underside of a square section fluid tube. The square fluid tube top surface is structured with an upstanding center blade along the tube length. This center blade constitutes the fluid flow barrier respective to the flushing film distribution fountain.

Applied to a screen edge cupping rail, one side-wall of a square section fluid conduit is provided with a plate bracket which projects beyond both side-wall edges: one projection serving as the fluid flow barrier for the flushing film distribution fountain and the other projection serving as an alignment and mounting bracket for securing the conduit to the top edge of a cupping rail.

DESCRIPTION OF THE DRAWINGS

Relative to the drawings wherein like reference characters designate like or similar elements throughout the several FIGURES of the drawings.

DESCRIPTION OF THE PREFERRED EMBODIMENT

Figure 1:
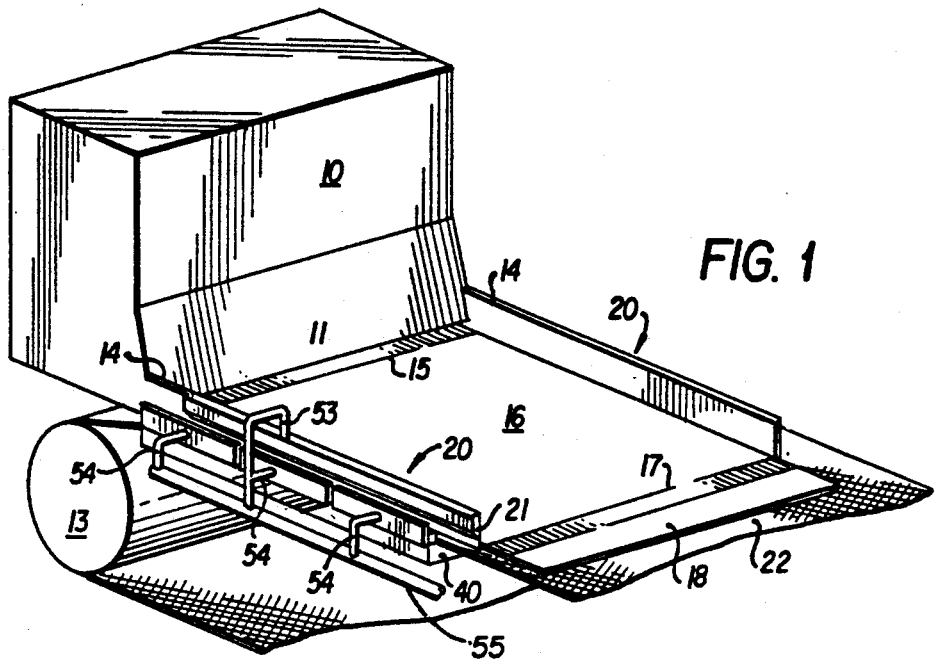
FIG. 1 is an abbreviated pictorial of a paper machine headbox section showing the present invention operatively combined therewith.

For environmental setting, FIG. 1 illustrates the relevant elements of a fourdrinier paper machine as comprising a headbox 10 which discharges dilute, aqueous papermaking stock from a slice opening 11 onto a horizontally carried, table segment of an endless belt screen 12. The screen is turned about and drawn from a breast roll 13 under headbox 10. Extensions 14 from the slice end wall, characterized as "pond sides" or "cheeking pieces," confine the fluid stock beyond the plane of discharge from the slice and may include the line of stock landing 15.

Dynamically, the jet of fluid stock lands upon the screen 12 which is moving at approximately the same horizontal velocity as the stock jet. Although drainage of the stock aqueous vehicle begins immediately, the initial drainage process continues for several seconds during which the stock remains as a highly fluidized pond 16. As this pond is carried away from the slice opening 11, water removal diminishes the pond depth until sufficient free water is removed to form a consolidated fibrous mat 18. That point of mat consolidation is observed on the paper machine as a "dry line" zone 17. Thus formed, the mat is further dried by pressure and heat to an integral, continuous paper web.

In transit, the pond 16 is laterally confined by deckle structure 20. Such deckle structure of the present invention is shown by FIGS. 2 through 5 as including a deckle board assembly and a screen edge cupping rail assembly 40.

Figure 2:
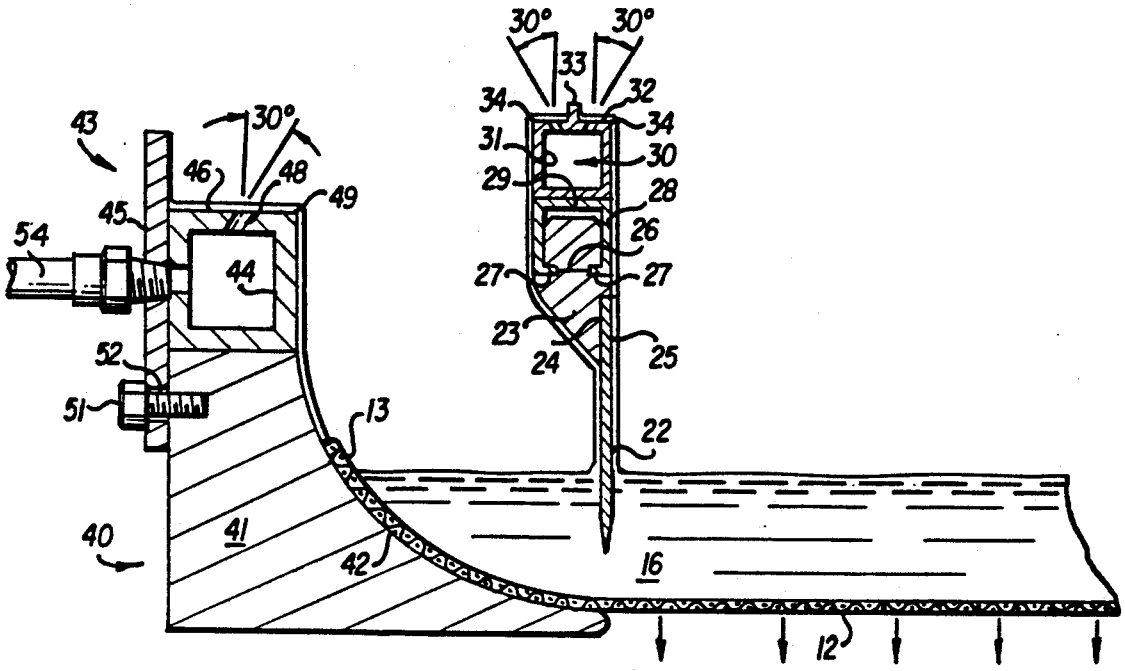
FIG. 2 is a sectional view of the present invention in operative combination with directly associated paper machine structure.

The deckle board assembly 21 is shown by FIG. 2 to comprise a thin, ($\frac{1}{8}$ in wide) polycarbonate (Lexan) blade 22 bonded to a polymethymethacrylate (Plexiglas) attachment body 23.

This structure is supported by a position adjustable bracket means not shown such as that disclosed by U.S. Pat. No. 3,607,624 to W. R. Moody et al. The attachment body 23 is shaped with a step 24 to receive the blade 22 thickness thereby providing an uninterrupted inside vertical surface 25. Above the blade 22, the block 23 is formed with a pair of longitudinal rail channels 26 which receive a corresponding pair of bracket rails 27 supported by a square section C-clip 28.

The bight section 29 of the C-clip is secured to a flushing fountain 30 comprising a square section conduit 31 having a substantially flat top surface 32. Longitudinally along the top surface midline is an upstanding blade or fluid barrier 33 secured to the surface as by welding. On both sides of the blade 33, between the respective vertical faces of the blade and the corresponding top surface edge 34, a series of fountain holes 36 @i and 37 communicate the interior of conduit 31 with the exterior elements of top surface 32.

Figure 4:
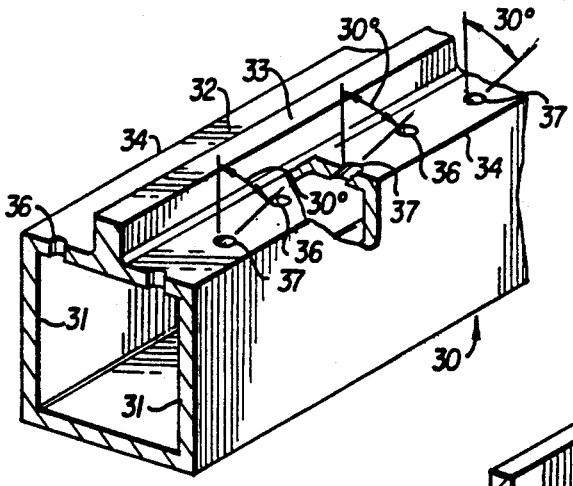
FIG. 4 is a sectioned detail of the deckle board embodiment of the present invention flushing film distribution fountain.
Figure 5:
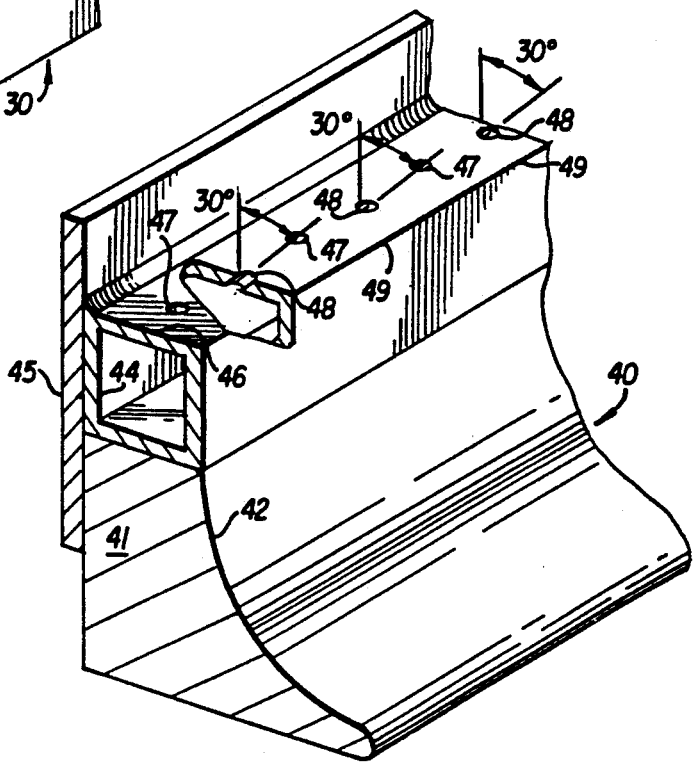
FIG. 5 is a sectional detail of a screen edge cupping rail embodiment of the present invention flushing film distribution fountain.

Bore axes of the holes are alternated between a vertical or 0° orientation for holes 36 to some angle between 10° and 45° for holes 37. The FIGS. 2 and 4 illustrated angle of 30° is merely representative. The axis angle for holes 37 is turned away from the center blade 33 and toward the weir edge 34 respective to both rows of holes.

Representative dimensioning for the fountain holes 36 and 37 may include a ratio of about 25% wherein the hole diameter is 20% of the hole spacing period. For example, a periodic distance of 174 inch between holes 36 and 37 would suggest a hole diameter of 1/16 inch.

The screen edge cupping rail assembly 40 comprises the rail element 41 having a concave inside surface 42 for supporting the lateral edges of the traveling screen 12. The "inside" orientation refers to the rail side most proximate of the screen 12 and the stock pond 16.

Figure 3:
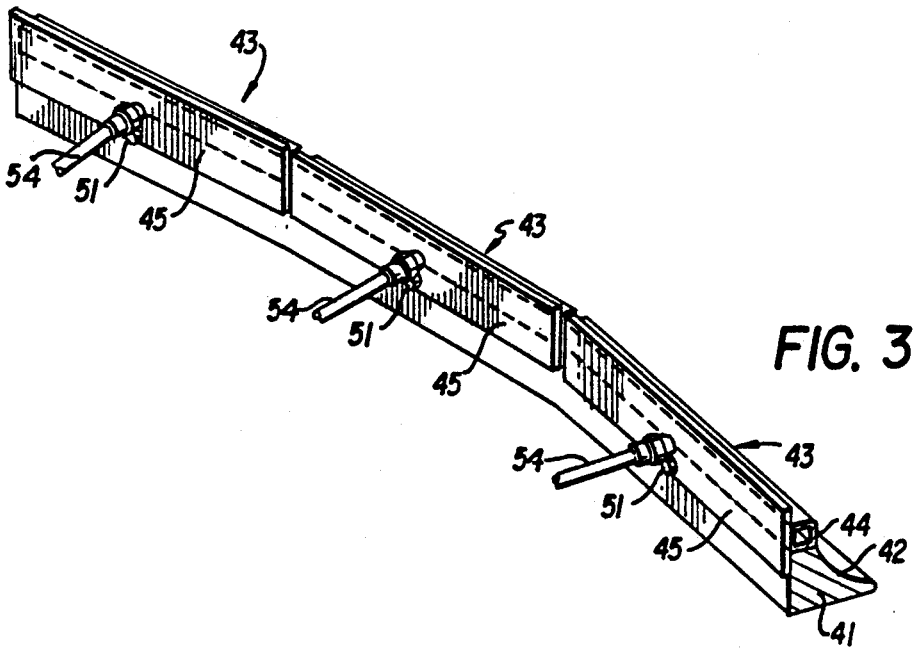
FIG. 3 is a detail of the invention in operative combination with a warped, screen edge cupping rail.

The top of rail 40 is crowned with a plurality of flushing fountain sections 43, each about 18 to 24 inches long, as illustrated by FIG. 3. Each fountain section comprises a square section fluid conduit 44 and a side plate 45. The fluid conduit provides a flat top surface 46 penetrated by holes 47 and 48 between the upwardly projected inside surface of side plate 45 and the weir edge 49 of top surface 46. Similar to the holes 36 and 37 in the deckle structure flushing fountain, holes 47 and 48 have an alternating bore axis orientation with the axis of holes 47 aligned at substantially 0° with vertical and the axis of holes 48 set at an angle of 15° to 45° from vertical toward the top surface weir edge 49.

The lower projected surface of side plate 45 provides a mounting clamp and alignment fence whereby the fountain section 43 may be secured to the rail element 41.

To obtain minute adjustments of the screen 12 travel profile, the edge cupping rail 41 is often secured to the paper machine forming table in a twisted and warped configuration as suggested by FIG. 3. If continuous along the length of rail 41, the rigidity of the flushing fountain conduit 44 and side plate 45 would prohibit such desired twisting of rail 41 when firmly secured thereto. However, by serving the rail assembly with short sections of flushing fountain 43, such twisting may be accommodated. For this reason, each fountain section 43 is secured by only one cap screw 51 through an oversized aperture 52 in the plate 45. By this means, small angular differences in the attachment angle between each fountain section 43 and a respective increment of the rail 41 may be accommodated. Other, more elaborate, adjustable anchoring mechanisms may be applied to this structural unit but the single cap screw 51 is adequate, simple and inexpensive.

To supply flushing water to each, independent fountain conduit 31 and 44, flexible hose conduits 53 and 54 connect the square section conduits to a supply manifold 55.

Operatively, water rises from the inside of square conduits 31 and 44 to flood the top surfaces 32 and 46. The flow barrier provided by vertical walls 33 and 45 cooperates with the hole bore axis orientation to distribute a substantially even thickness water film flow over the weir edge 34 and 49. Below the weir edges, the deckle and rail structures are smoothly faired into the fourdrinier pond 16 to maintain the film distribution. To the extent that localized surface irregularities and discontinuities exist along the conduit top surfaces, the angular axis holes 37 and 48 push the flow over the wire edges and prevent channeling. To the extent that film distribution is maintained, no dry surface is available for splash fiber accumulation.

Numerous alternative and mechanically equivalent design configurations may be devised for particular invention features. For example, the deckle blade 22 may be inserted into a central slot along the attachment body 23 with both sides tapered fairly into the deckle blade side planes. As my invention, however,

I claim:

1. In a paper machine, a paper machine deckle means comprising a horizontally elongated C-clip support beam having a pair of spacially separated, parallel support walls and at least one longitudinal guide rail means depending therefrom, an elongated deckle blade body means having a longitudinal guide channel means for receiving said guide rail means when said body means is inserted within a separation space between said support walls, a thin deckle blade means wherein said deckle blade body means comprises a stepped receptacle surface for receiving a section of said thin deckle blade means, said deckle blade body means having smooth and continuously faired surfaces below said support beam onto the surface of said thin deckle blade means.

2. The paper machine deckle means as described by claim 1 wherein said support beam comprises a square section C-clip wherein said support walls depend substantially 90° from a flat bight section between said support walls.

3. The paper machine deckle means of claim 1 wherein said guide rail means is further comprised of:

at least two guide rails.

4. The paper machine deckle means as described by claim 3 wherein said C-clip support walls are terminated by respective guide rails.

5. The paper machine deckle means as described by claim 1 wherein said thin section deckle blade means is assembled with said deckle blade body means and said support beam to provide a smooth and substantially continuous vertical surface from said support beam to a bottom edge of said deckle blade means.

6. In a fourdrinier paper machine having a deckle means positioned for delineating lateral edges of a stock drainage pond carried on a traveling screen, said deckle means comprising an assembly of an elongated C-clip having a pair of parallel support walls wherein said C-clip support walls are terminated by respectively opposed guide rails and a deckle blade body configured for secure confinement between said support walls, wherein said blade body comprises a pair of guide channels for corresponding reception of said C-clip guide rails and a stepped receptacle surface, said assembly structured and arranged so that a substantially smooth and continuous vertical surface faces said drainage pond from an upper element of said respective C-clip support walls to a lower element of a thin section blade portion of said blade body, wherein said thin section blade portion of said blade body is of a material composition distinct from other elements of said blade body and is substantially located in said stepped receptacle surface of said blade body.

7. In a paper machine as described by claim 6 wherein said C-clip support walls depend substantially normally from a straight bight section therebetween.

* * * * *

UNITED STATES PATENT AND TRADEMARK OFFICE

CERTIFICATE OF CORRECTION

PATENT NO. : 5,296,101

DATED : Mar. 22, 1994

INVENTOR(S) : Ralph S. Peterson

It is certified that error appears in the above-indentified patent and that said Letters Patent is hereby corrected as shown below:

On the title page, Item [54]:

In the title preceding "PAPER" insert --A--. Column 3, line 39, following "assembly" insert --21--. Column 3, line 62, delete "@i".

Signed and Sealed this

Fifth Day of July, 1994

*Attest:*

*Attesting Officer*

Bruce Lehman

BRUCE LEHMAN

*Commissioner of Patents and Trademarks*